US009248990B2

(12) United States Patent
Morita

(10) Patent No.: US 9,248,990 B2
(45) Date of Patent: Feb. 2, 2016

(54) SHEET EJECTION TRAY

(71) Applicant: RISO KAGAKU CORPORATION, Tokyo (JP)

(72) Inventor: Yoshihisa Morita, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 13/872,671

(22) Filed: Apr. 29, 2013

(65) Prior Publication Data

US 2013/0307211 A1 Nov. 21, 2013

(30) Foreign Application Priority Data

May 16, 2012 (JP) ..... 2012-112183

(51) Int. Cl.

| | |
|---|---|
| ***B65H 31/02*** | (2006.01) |
| ***B65H 31/00*** | (2006.01) |
| ***B65H 85/00*** | (2006.01) |
| ***G03G 15/00*** | (2006.01) |

(52) U.S. Cl.

CPC ..... *B65H 31/00* (2013.01); *B65H 31/02* (2013.01); *B65H 85/00* (2013.01); *G03G 15/6552* (2013.01); *B65H 2301/4212* (2013.01); *B65H 2405/1111* (2013.01); *B65H 2405/11151* (2013.01); *B65H 2405/11161* (2013.01); *B65H 2601/324* (2013.01)

(58) Field of Classification Search

CPC ..... B65H 31/00; B65H 31/02; B65H 31/12; B65H 31/20; B65H 31/26; B65H 31/34; B65H 2405/10; B65H 2405/111; B65H 2405/1111; B65H 2405/1113; B65H 2405/11131; B65H 2405/1114; B65H 2405/11141; B65H 2405/1115; B65H 2405/11151; B65H 2405/11152; B65H 2405/1116; B65H 2405/11161; B65H 2405/1132; B65H 2405/1136; B65H 2405/1138; B65H 2405/1142; B65H 2405/144141

USPC ..... 271/207, 209, 213, 220, 223; 399/405

See application file for complete search history.

(56) References Cited

U.S. PATENT DOCUMENTS

| | | | | |
|---|---|---|---|---|
| 3,793,950 | A * | 2/1974 | Kaneko et al. | 101/142 |
| 5,377,966 | A * | 1/1995 | Ohmori | 271/4.01 |
| 5,709,382 | A * | 1/1998 | Shima | 271/209 |
| 5,791,642 | A * | 8/1998 | Sawano et al. | 270/58.01 |
| 5,984,299 | A * | 11/1999 | Hirota et al. | 271/161 |
| 7,099,618 | B2 * | 8/2006 | Iwago et al. | 399/367 |
| 7,484,729 | B2 * | 2/2009 | Ono et al. | 271/209 |

(Continued)

FOREIGN PATENT DOCUMENTS

| | | | |
|---|---|---|---|
| JP | 2000198605 | A * | 7/2000 |
| JP | 2007-055707 | | 3/2007 |

*Primary Examiner* — Ernesto Suarez

(74) *Attorney, Agent, or Firm* — Greenblum & Bernstein, P.L.C.

(57) ABSTRACT

A sheet ejection tray on which a sheet ejected from a sheet ejection port lands, includes: an inclined surface that becomes higher as farther from the sheet ejection port in a sheet ejecting direction; a projecting member that is provided in a region closer to the sheet ejection port than the position on which a leading end of the sheet having a dimension not smaller than a predetermined value lands and which has a guiding surface more inclined than the inclined surface; and an abutting cover that contacts a rear end of the sheet moving toward the sheet ejection port due to the inclination of the guiding surface. The leading end of the sheet passes above the projecting member before landing on the guiding surface. A portion of the sheet closer to the sheet ejection port than the leading end lands on the guiding surface.

18 Claims, 6 Drawing Sheets

(56) References Cited

U.S. PATENT DOCUMENTS

| | | | | |
|---|---|---|---|---|
| 7,722,034 | B2 * | 5/2010 | Kosuda et al. | 271/223 |
| 7,748,705 | B2 * | 7/2010 | Yamada | 271/209 |
| 7,950,652 | B2 * | 5/2011 | Terao et al. | 271/220 |
| 8,960,667 | B2 * | 2/2015 | Nakamura | B65H 31/02 271/209 |
| 2013/0075969 | A1 * | 3/2013 | Akiyama | B65H 31/02 271/207 |

* cited by examiner

SHEET EJECTION TRAY

CROSS REFERENCE TO RELATED APPLICATION

This application claims benefit of priority under 35 U.S.C. §119 to Japanese Patent Application No. 2012-112183 filed on May 16, 2012, the entire contents of which are incorporated by reference herein.

BACKGROUND OF THE INVENTION

1. Field of the Invention

The present invention relates to a sheet ejection tray onto which sheets having images formed thereon are ejected from an image forming apparatus and stacked.

2. Description of the Related Art

In order to respond to a need of reducing the thickness of sheets used for contents in an envelope and the like, for example, thin sheets are provided as a type of sheets used in the image forming apparatus. Since the thin sheets are not sturdy, leading ends of the sheets might be lifted up or rolled by air resistance received from the peripheral air when being ejected onto a sheet ejection tray. Such a phenomenon is particularly remarkable during high-speed printing when the sheets are conveyed at a high speed. Thus, sheet alignment of the ejected sheets on the sheet ejection tray and the like are adversely affected.

Conventional proposals for improving sheet alignment when thin sheets are ejected onto the sheet ejection tray include handling of the above-described problem by suspending the leading end of a sheet by using air resistance during sheet ejection, for example. However, if the leading end of the sheet is suspended during ejection, the leading end of the sheet lands on the sheet ejection tray and is caught by the sheet ejection tray before a position where the sheet should have been ejected, and the sheet is ejected onto the sheet ejection tray in a state where the leading end side is rolled inward. Such sheets cause disturbance in alignment of subsequent sheets ejected onto the sheet ejection tray.

Therefore, in the above-described conventional proposal, an inclined surface with inclination larger than that of the sheet ejection tray is provided on the sheet ejection tray. This inclined surface is brought into contact with the suspended leading end of the sheet ejected onto the sheet ejection tray and corrects the direction of the sheet leading end to above a sheet ejection tray surface (Patent Literature 1: Japanese Patent Application Laid-Open Publication No. 2007-55707, for example).

In an image forming apparatus in which a conveying speed of the sheet is increased in accordance with the high-speed printing, a sheet ejecting speed of the sheet with respect to the sheet ejection tray is high, and a distance for which the sheet moves until it lands on the sheet ejection tray becomes longer. Thus, sheet alignment tends to be disturbed by air resistance received by the sheet from the periphery. Thus, in an image forming apparatus adapted to high-speed printing, a sheet landing on the sheet ejection tray is moved so as to return to the base end side of the sheet ejection tray by using the inclination of the sheet ejection tray, and a rear end of the sheet is brought into contact with an abutting cover on the base end of the sheet ejection tray, which is effective in improvement of sheet alignment.

However, if the leading end of the sheet ejected onto the sheet ejection tray is brought into contact with the inclined surface on the sheet ejection tray as in the above-described conventional proposal, when the sheet slides down the inclined surface with inclination larger than that of the sheet ejection tray, the sheet is accelerated, and the rear end of the sheet is brought into contact with the abutting cover in a rush. Then, the rear end side of the sheet is swollen and curved by the rush when the sheet is brought into contact with the abutting cover. Such a sheet causes new disturbance in sheet alignment of the sheets to be subsequently brought into contact with the abutting cover.

The above-described problem often occurs particularly in a thin sheet having a dimension not smaller than a predetermined value in the sheet ejecting direction (feeding direction). On the other hand, since the thin sheet having a dimension less than the predetermined value in the sheet ejecting direction has rigidity higher than that of the thin sheet having a dimension not smaller than the predetermined value, the sheet withstands an impact received by the sheet rear end at contact with the abutting cover and the sheet is not curved. This is considered to be the reason for the above-described problem.

Therefore, even with the sheet having a dimension less than the predetermined value in the sheet ejecting direction when being conveyed with the short side conforming to the feeding direction, if the sheet is conveyed with the long side of the sheet conforming to the feeding direction, the dimension becomes not smaller than the predetermined value in the sheet ejecting direction, and the above-described problem might occur.

SUMMARY OF THE INVENTION

The present invention was made in view of the above-described circumstances and has an object to provide a sheet ejection tray with which sheet alignment is hard to be disturbed even if a thin sheet is ejected.

According to a first aspect of the present invention, there is provided a sheet ejection tray on which a sheet ejected from a sheet ejection port of an image forming apparatus lands and which guides the sheet to a stacking position, including: an inclined surface in which the farther it is from the sheet ejection port in an ejecting direction of the sheet, the higher a position becomes; a projecting member provided in a region closer to the sheet ejection port than the position on which a leading end of a sheet having a dimension not smaller than a predetermined value lands in the ejecting direction and having a guiding surface with inclination larger than that of the inclined surface; and an abutting cover brought into contact with a rear end of the sheet moving to the sheet ejection port side due to the inclination of the guiding surface after the sheet lands on the guiding surface, wherein the leading end of the sheet having the dimension not smaller than the predetermined value passes above the projecting member before landing on the guiding surface; and a portion of the sheet having the dimension not smaller than the predetermined value, closer to the sheet ejection port than the leading end of the sheet, lands on the guiding surface.

According to a second aspect of the present invention, the projecting member is provided at the center of the inclined surface in a sheet width direction orthogonal to the sheet ejecting direction, and the guiding surface has a width smaller than a width of the inclined surface in the sheet width direction.

According to a third aspect of the present invention, the projecting member is configured capable of adjusting at least one of inclination and width of the guiding surface.

According to a fourth aspect of the present invention, the projecting member is provided in a region farther from the sheet ejection port than a leading end of the sheet which has a dimension not smaller than the predetermined value and is placed at the stacking position.

According to a fifth aspect of the present invention, an end portion on the sheet ejection port side of the projecting member in the sheet ejecting direction is arranged in a region closer to the sheet ejection port than the leading end of the sheet which has a dimension not smaller than the predetermined value and is placed at the stacking position.

Note that, in an image forming apparatus in which a sheet after formation of an image is ejected onto the sheet ejection tray from the sheet ejection port, the image forming apparatus may be configured to have the sheet ejection tray of the first, second, third, fourth or fifth aspect of the present invention as the sheet ejection tray.

According to the present invention, it can be so configured that sheet alignment is hard to be disturbed even if a thin sheet is ejected.

That is, according to the sheet ejection tray according to the first aspect of the present invention, if a sheet having a dimension not smaller than a predetermined value in the sheet ejecting direction is ejected from the sheet ejection port, after the leading end of the sheet passes above the projecting member, the portion of the sheet closer to the sheet ejection port than the leading end lands on the guiding surface of the projecting member. The sheet portion having landed on the guiding surface moves to the sheet ejection port side due to the inclination of the inclined surface while rubbing on the guiding surface and is guided to the stacking position.

At this time, since a speed at which the sheet having the dimension not smaller than the predetermined value moves to the sheet ejection port side is reduced by sliding resistance received by the sheet having the dimension not smaller than the predetermined value in the sheet ejecting direction from the projecting member, an impact generated when the rear end of the sheet is brought into contact with the abutting cover is relaxed. Therefore, even with the sheet having the dimension not smaller than the predetermined value in the sheet ejecting direction and low rigidity in the sheet ejecting direction, the rear end side of the sheet can be prevented from being swollen and curved by the rush when being brought into contact with the abutting cover. Thus, even if a thin sheet of the size having a dimension not smaller than the predetermined value in the sheet ejecting direction is ejected, sheet alignment can be made hard to be disturbed.

According to the sheet ejection tray according to the second aspect of the present invention, in the vicinity of the leading end of the sheet having the dimension not smaller than the predetermined value in the sheet ejecting direction and having landed on the guiding surface of the projecting member, the center part in the sheet width direction in contact with the projecting member is located above the both end parts. Thus, the portion at least on the leading end side of the sheet having the dimension not smaller than the predetermined value in the sheet ejecting direction is brought into a state curved in the sheet width direction.

Thus, when the sheet having the dimension not smaller than the predetermined value in the sheet ejecting direction moves to a stacking spot due to inclination on the inclined surface, while the leading end side of the sheet is present on the guiding surface, the curved state in the sheet width direction on the sheet leading end side is maintained, and rigidity in the sheet ejecting direction of the sheet having the dimension not smaller than the predetermined value in the sheet ejecting direction is reinforced. Thus, impact resistance when the rear end is brought into contact with the abutting cover can be improved, and the rear end side of the sheet having the dimension not smaller than the predetermined value in the sheet ejecting direction can be prevented from being swollen and curved more efficiently. Therefore, when the thin sheet having the dimension not smaller than the predetermined value in the sheet ejecting direction is ejected, disturbance in sheet alignment can be prevented more reliably.

According to the sheet ejection tray according to the third aspect of the present invention, if the inclination of the guiding surface of the projecting member is changed, after the portion of the sheet closer to the sheet ejection port than the leading end of the sheet having the dimension not smaller than the predetermined value in the sheet ejecting direction lands on the guiding surface, the speed when the sheet moves to the sheet ejection port side while rubbing on the guiding surface is changed. As a result, when the rear end of the sheet is brought into contact with the abutting cover, a degree of the impact received by the sheet having the dimension not smaller than the predetermined value in the sheet ejecting direction is changed.

Moreover, if the width of the guiding surface of the projecting member in the sheet width direction is changed, a degree of curving on the leading end side of the sheet having the dimension not smaller than the predetermined value in the sheet ejecting direction is changed, and rigidity in the sheet ejecting direction of the sheet having the dimension not smaller than the predetermined value in the sheet ejecting direction is changed.

Therefore, in accordance with a change in rigidity in the sheet ejecting direction originally provided in the sheet having the dimension not smaller than the predetermined value in the sheet ejecting direction in a flat state depending on the length of the sheet dimension in the sheet ejecting direction, an impact or the rigidity in the sheet ejecting direction when the sheet rear end is brought into contact with the abutting cover can be changed by adjustment of at least one of the inclination and the width in the sheet width direction of the guiding surface of the projecting member. As a result, the rear end side of the sheet having the dimension not smaller than the predetermined value in the sheet ejecting direction can be appropriately prevented from being swollen and curved by the rush when the rear end is brought into contact with the abutting cover.

According to the sheet ejection tray according to the fourth aspect of the present invention, when the sheet having the dimension not smaller than the predetermined value in the sheet ejecting direction has moved to the stacking position, the sheet does not overlap on the projecting member. Thus, the sheet having the dimension not smaller than the predetermined value in the sheet ejecting direction can be stacked in a stable and flat attitude at the stacking position.

According to the sheet ejection tray according to the fifth aspect of the present invention, the sheet having the dimension not smaller than the predetermined value in the sheet ejecting direction maintains a state where the sheet leading end side is curved until the sheet has moved to the stacking position and the rear end is brought into contact with the abutting cover. Thus, by configuring such that the sheet rear end is brought into contact with the abutting cover while keeping a state where the rigidity in the sheet ejecting direction is reinforced by curving in the sheet width direction, the rear end side of the sheet having the dimension not smaller than the predetermined value in the sheet ejecting direction can be prevented more reliably from being swollen and curved by the impact of the contact with the abutting cover.

Note that, if an image forming apparatus having the sheet ejection tray of the first, second, third, fourth or fifth aspect of the present invention is configured, the effect obtained by the sheet ejection tray of the first, second, third, fourth or fifth aspect of the present invention can be exerted.

DESCRIPTION OF THE EMBODIMENTS

Figure 1:
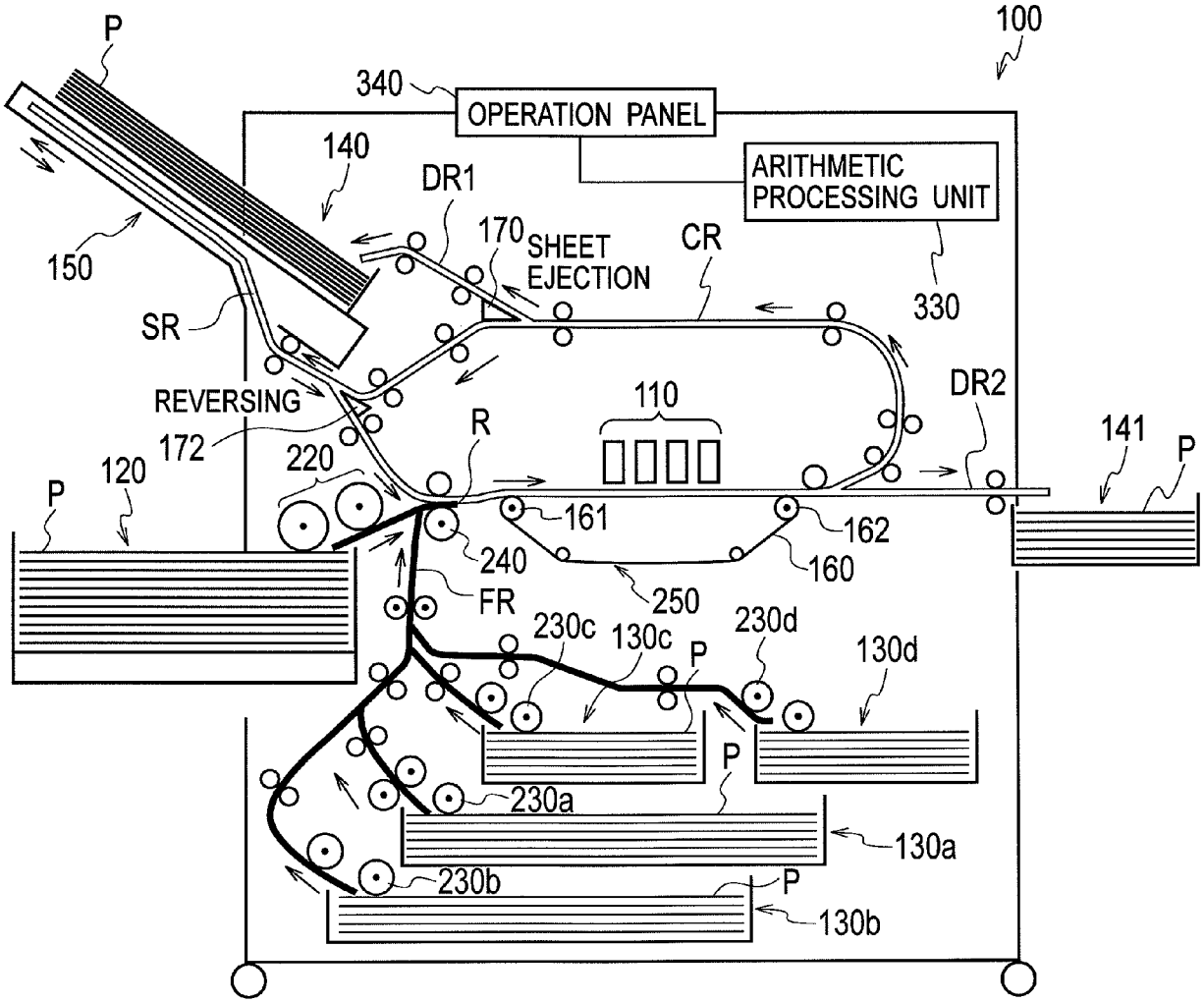
FIG. 1 is an explanatory diagram schematically illustrating an outline configuration of a printer in which a sheet ejection tray according to an embodiment of the present invention is provided.

Embodiments of the present invention will be described below by referring to the attached drawings. FIG. 1 is a diagram schematically illustrating an internal configuration of a printer in which a sheet ejection tray according to the embodiments of the present invention is provided.

(Entire Configuration of Printer)

A printer 100 of the present embodiment illustrated in FIG. 1 is an inkjet-type line color printer. Therefore, the printer 100 includes a plurality of head units 110 each of which a large number of nozzles are formed. Each of the respective head units 110 discharges black or color ink and carries out printing by the unit of line and forms a plurality of images on a sheet P on a conveying belt so that they are overlapped with each other.

The printer 100 forms an image on the sheet P being conveyed on a ring-shaped conveying path by using the plurality of head units 110. This conveying path has a normal conveying path CR and a reversing path SR.

The normal conveying path CR conveys the sheet P which has been fed to a resist portion R, from a sheet feeding path FR to the head unit 110 and conveys the sheet P on which an image has been formed by the head unit 110 to a sheet ejecting path DR1. The sheet ejecting path DR1 is a path for conveying (ejecting) the sheet P on the conveying path to a sheet ejection port 140 on which a sheet ejection tray 150 is mounted. Moreover, the normal conveying path CR is also a path for conveying (ejecting) a part of the sheets P to be ejected to a face-up sheet ejection port 141, to a linear sheet ejecting path DR2.

The normal conveying path CR has a resist driving portion 240 for guiding the sheet P fed from the sheet feeding path FR to the resist portion R and a belt driving portion 250 for endlessly moving a conveying belt 160 provided on a surface thereof opposite to the head unit 110 by a driving roller 162. The conveying belt 160 is extended between a driven roller 161 and a driving roller 162 disposed on a front end and a rear end of the surface opposite to the head unit 110 and circles and moves clockwise in FIG. 1.

The sheet feeding path FR is a path for conveying (feeding) the sheet P from sheet feed trays 130*a* to 130*d* and a side sheet feed base 120 to the resist portion R. The sheet feeding path FR has a sheet feeding path for conveying the sheet P from the sheet feed trays 130*a* to 130*d* by tray driving portions 230*a* to 230*d* to the normal conveying path CR and a sheet feeding path for feeding the sheet P from the side sheet feed base 120 by a side sheet feed driving portion 220.

The reversing path SR conveys the sheet P from a connection point between the normal conveying path CR and the sheet ejecting path DR1 to a space for switchback in the sheet ejection tray 150 and conveys the sheet P reversed upside-down by means of the switchback to the resist portion R of the normal conveying path CR. A conveying destination of the sheet P from the normal conveying path CR is switched by a switching mechanism 170 between the sheet ejecting path DR1 and the reversing path SR. Moreover, the conveying path of the sheet P is switched by a switching mechanism 172 between conveying of the sheet P to the space for switchback and conveying of the sheet P from the space for switchback to the resist portion R.

Note that, a portion of the reversing path SR from the sheet ejection tray 150 to the resist portion R also constitutes a part of the sheet feeding path FR.

The sheet P is set on the side sheet feed base 120 and sheet feed trays 130*a* to 130*d*, respectively. The sheet feed trays 130*a* to 130*d* are so-called sheet feed cassettes and capable of setting sheets P with different sizes (A4, A3, B4, B5 and the like), direction (vertical, lateral), and sheet quality, respectively (thick and heavy sheet, thin and light sheet and the like, for example). The side sheet feed base 120 is a so-called manual feeding tray and capable of setting a sheet P with an arbitrary specification and capable of being conveyed by the conveying path.

Moreover, the printer 100 includes an arithmetic processing unit 330. This arithmetic processing unit 330 is an arithmetic module composed by hardware including a processor such as a CPU, DSP (Digital Signal Processor) and the like, memory, and other electronic circuits and the like or software such as a program having the function or combinations thereof.

The arithmetic processing unit 330 virtually constructs various functional modules by reading and executing the program as appropriate. The arithmetic processing unit 330 executes processing relating to image data, operation control of each portion, and various types of processing to a user operation by each of the functional modules thus configured. Moreover, an operation panel 340 is connected to the arithmetic processing unit 330. The arithmetic processing unit 330 can receive an instruction and a setting operation by a user through the operation panel 340.

(First Embodiment of Sheet Ejection Tray)

Figure 2:
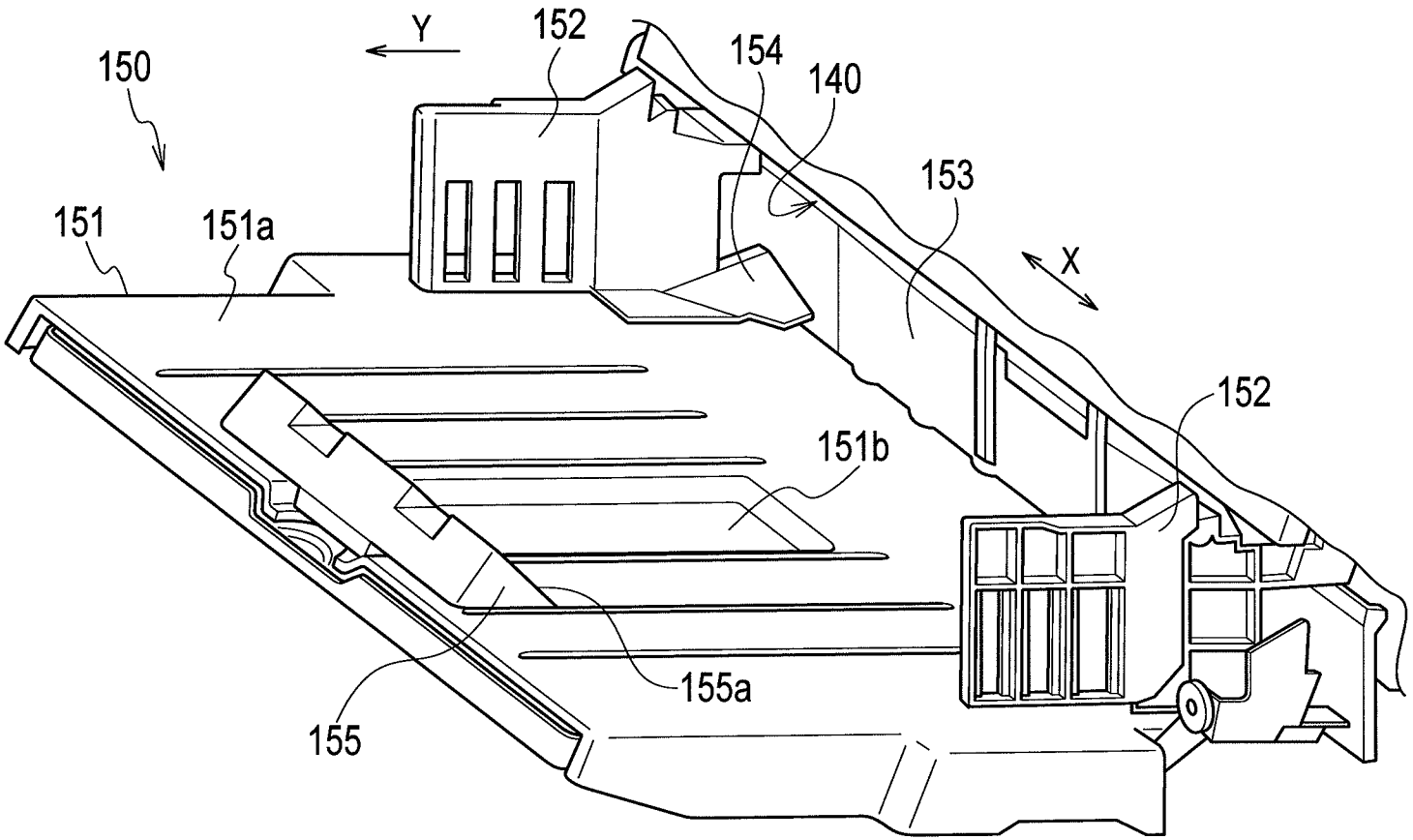
FIG. 2 is an enlarged perspective view of the sheet ejection tray according to a first embodiment of the present invention used in the printer in FIG. 1.

The sheet P ejected from the sheet ejection port 140 through the above-described sheet ejecting path DR1 is stacked on the sheet ejection tray 150. FIG. 2 is an appearance perspective view illustrating the sheet ejection tray according to a first embodiment of the present invention.

As illustrated in FIG. 2, the sheet ejection tray 150 according to the present embodiment is for stacking the sheet P printed by the printer 100 and ejected from the sheet ejection port 140. The sheet ejection tray 150 is positioned on a housing upper edge portion of the printer 100. In the housing upper edge portion, a rear end portion is mounted by being embedded in the housing. A portion excluding the rear end portion of the sheet ejection tray 150 is exposed to the outside of the housing of the printer 100.

The sheet ejection tray 150 is provided on the sheet ejection port 140 continuing to the sheet ejecting path DR1 and includes a tray main body 151 having an inclined surface 151*a*, a pair of side fences 152 and 152, an abutting cover 153, and a pair of rigidity-imparting members 154 and 154.

The sheet ejection tray 150 is provided at a drop position of the sheet P ejected from the sheet ejection port 140 and includes the tray main body 151 having the inclined surface 151*a* with a predetermined angle rising in the ejecting direction (Y-direction in the figure) of the sheet P. The tray main body 151 is a receiver for stacking the sheets P on the inclined surface 151*a*. On the inclined surface 151*a*, the sheets P sequentially ejected from the sheet ejection port 140 are placed in the stacked state.

The pair of side fences 152 and 152 are arranged on both outer sides in a width direction X of the sheet P ejected onto the inclined surface 151*a* of the tray main body 151 from the sheet ejection port 140 and provided capable of relative movement in the width direction X with respect to the tray main body 151.

An interval between these side fences 152 and 152 can be set in accordance with the size of the sheet P and is normally slightly wider than the width of the sheet P ejected. By entry of the ejected sheet P into a space between the pair of side fences 152 and 152, the side fences 152 and 152 regulates movement of the sheets in the width direction X of the sheet P and aligns the sheets.

Moreover, the rigidity-imparting members 154 and 154 are provided at the lowermost part of the pair of side fences 152 and 152, respectively. On the rigidity-imparting members 154 and 154, the both side portions in the width direction X of the rear end of the sheet P ride, when the sheet P ejected onto the sheet ejection tray 150 moves to the sheet ejecting direction Y side on the inclined surface 151*a*. As a result, a curved portion is formed on the rear end side of the sheet P so that the center of the width direction X is located below the both ends, and rigidity in the sheet ejecting direction Y of the rear end portion of the sheet P is improved.

The abutting cover 153 is, as illustrated in FIG. 2, provided on the rear end portion of the tray main body 151 in the sheet ejecting direction Y. The abutting cover 153 has a substantially upright plate shape. Moreover, the abutting cover 153 is to align the sheets P in the sheet ejecting direction Y such that the sheet P ejected from the sheet ejection port 140 returns to the rear in the sheet ejecting direction Y while sliding on the inclined surface 151*a* of the tray main body 151 and the rear end portion of the sheet P in the sheet ejecting direction Y abuts on the abutting cover 153.

Meanwhile, the longer the dimension of the sheet P in the sheet ejecting direction Y is, the lower the rigidity of the sheet P in the sheet ejecting direction Y becomes. Particularly, rigidity is remarkably low if the sheet P is thin and lightweighted. If rigidity of the sheet P in the sheet ejecting direction Y is low, the rear end side of the sheet P is swollen and curved by the rush with which the rear end of the sheet P having slid on the inclined surface 151*a* of the tray main body 151 is brought into contact with the abutting cover 153. Such sheet P causes disturbance in sheet alignment of the subsequent sheet P to be brought into contact with the abutting cover 153.

Thus, in the sheet ejection tray 150 of the present embodiment, a projecting member 155 is provided on the inclined surface 151*a* of the tray main body 151. This projecting member 155 presents a triangular prism shape having a triangular side face when seen from the width direction X and is slidably supported in the sheet ejecting direction Y by a recess groove 151*b* formed in the center part in the width direction X of the inclined surface 151*a*. The projecting member 155 has a guiding surface 155*a* with inclination larger than that of the inclined surface 151*a* on the sheet ejection port 140 side.

Figure 3:
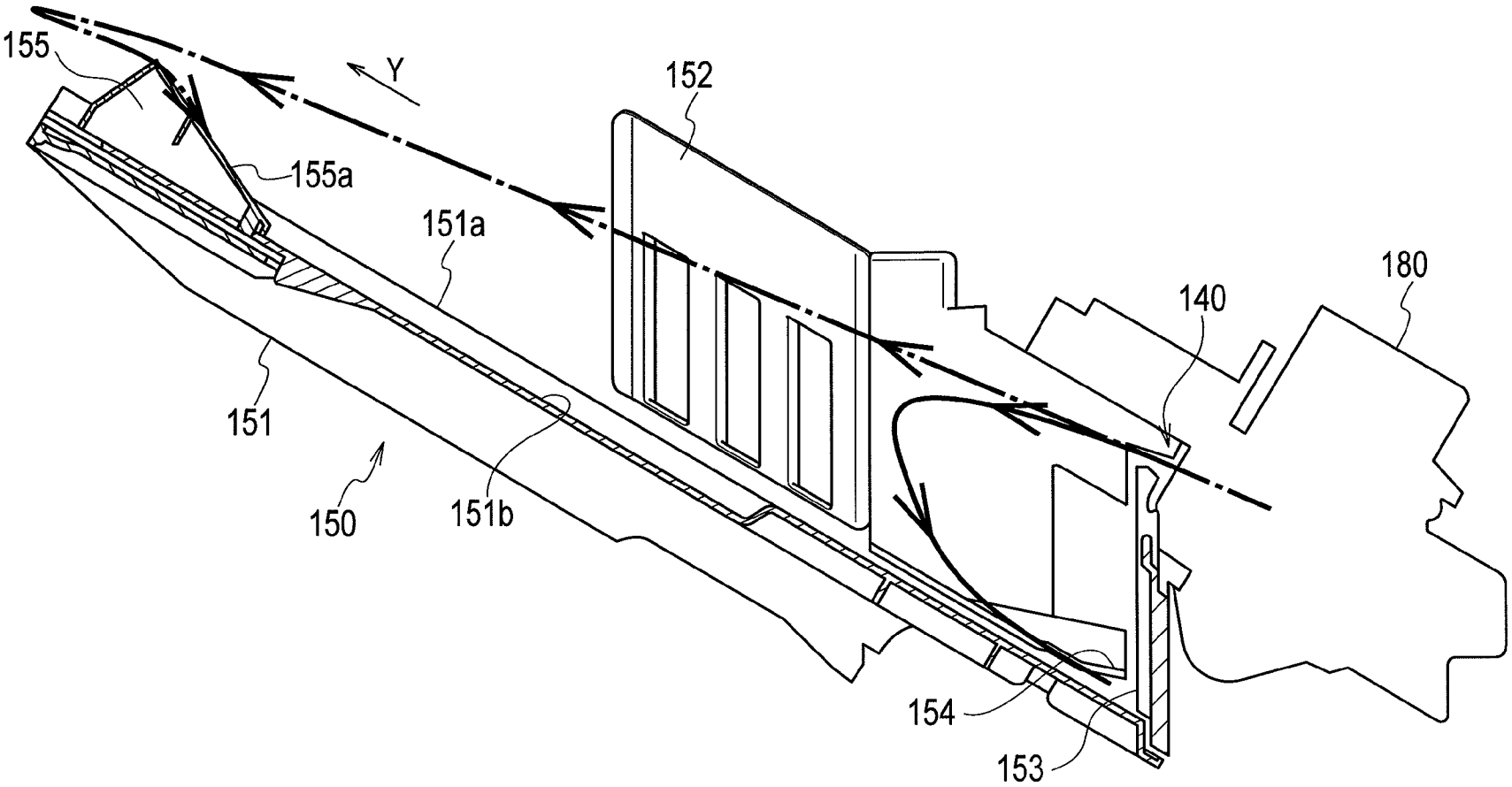
FIG. 3 is a sectional view illustrating each position on the sheet ejection tray of a projecting member in FIG. 2.

The above-described projecting member 155 is, as illustrated in FIG. 3, arranged in a region on the inclined surface 151*a* of the tray main body 151 closer to the sheet ejection port 140 than a position on which the leading end of the sheet P with a large size having a dimension not smaller than a predetermined value in the sheet ejecting direction Y (sheet P of the A3 size in which the long side is extended in the sheet ejecting direction Y, for example) lands.

Note that, reference numeral 180 in FIG. 3 indicates a sheet ejection driving portion provided on the terminal end portion of the sheet ejecting path DR1. By means of a motor and a roller of the sheet ejection driving portion 180, the sheet P is ejected from the sheet ejection port 140 onto the sheet ejection tray 150 at the same speed as the conveying speed on the conveying path.

A one-dot chain line arrow in FIG. 3 is a trajectory followed by the leading end of the large-sized sheet P ejected from the sheet ejection port 140 by the sheet ejection driving portion 180, while a solid line arrow is a trajectory followed by the rear end of the similarly large-sized sheet P. Note that, FIG. 3 illustrates a section of the sheet ejection tray 150 at the center in the width direction X, and the trajectory of the rear end of the sheet P is a trajectory passing below the rigidity-imparting member 154. However, on the both ends in the width direction X, the trajectory of the rear end of the sheet P is a trajectory passing above the rigidity-imparting member 154.

As described above, the leading end of the large-sized sheet P ejected from the sheet ejection port 140 passes above the projecting member 155 before landing on the inclined surface 151*a*. Then, after passing above the projecting member 155, the portion closer to the sheet ejection port 140 than the leading end of the sheet P lands on the guiding surface 155*a* of the projecting member 155. The sheet P portion having landed on the guiding surface 155*a* moves to the sheet ejection port 140 side due to inclination of the inclined surface 151*a* while rubbing on the guiding surface 155*a*. Then, the sheet P is guided to the stacking position where the rear end is brought into contact with the abutting cover 153.

At this time, since the speed of the large-sized sheet P moving to the sheet ejection port 140 side is reduced by sliding resistance received from the projecting member 155, an impact generated when the rear end of the sheet P is brought into contact with the abutting cover 153 is relaxed. Therefore, even if the large-sized thin sheet P having a dimension in the sheet ejecting direction Y not smaller than a predetermined value and low rigidity in the sheet ejecting direction Y is ejected onto the sheet ejection tray 150, the rear end side of the sheet P can be prevented from being swollen and curved by the rush when it is brought into contact with the abutting cover 153. Thus, even if the large-sized thin sheet P is ejected from the sheet ejection port 140, sheet alignment of the sheet P can be made hard to be disturbed.

Note that, in the present embodiment, arrangement of the projecting member 155 in the sheet ejecting direction Y is determined so that the leading end of the sheet P is located in the middle of the guiding surface 155*a* in a state where the rear end of the sheet P is brought into contact with the abutting cover 153 and the sheet P is guided to the stacking position. As a result, the sheet P can be moved to the stacking spot reliably by having a force for guiding the sheet P to the stacking spot due to the inclination of the guiding surface 155*a* continuously work until the sheet P reaches the stacking spot.

On the other hand, the arrangement of the projecting member 155 in the sheet ejecting direction Y may be determined so that the leading end of the sheet P is located closer to the sheet ejection port 140 side than the guiding surface 155*a* when the sheet P is guided to the stacking spot. As a result, the sheet P can be stacked in a stable and flat attitude on the inclined surface 151*a* at the stacking spot.

(Second Embodiment of Sheet Ejection Tray)

Subsequently, the sheet ejection tray 150 according to a second embodiment that can be used in the printer 100 in FIG. 1 will be described by referring to FIG. 4.

Figure 4:
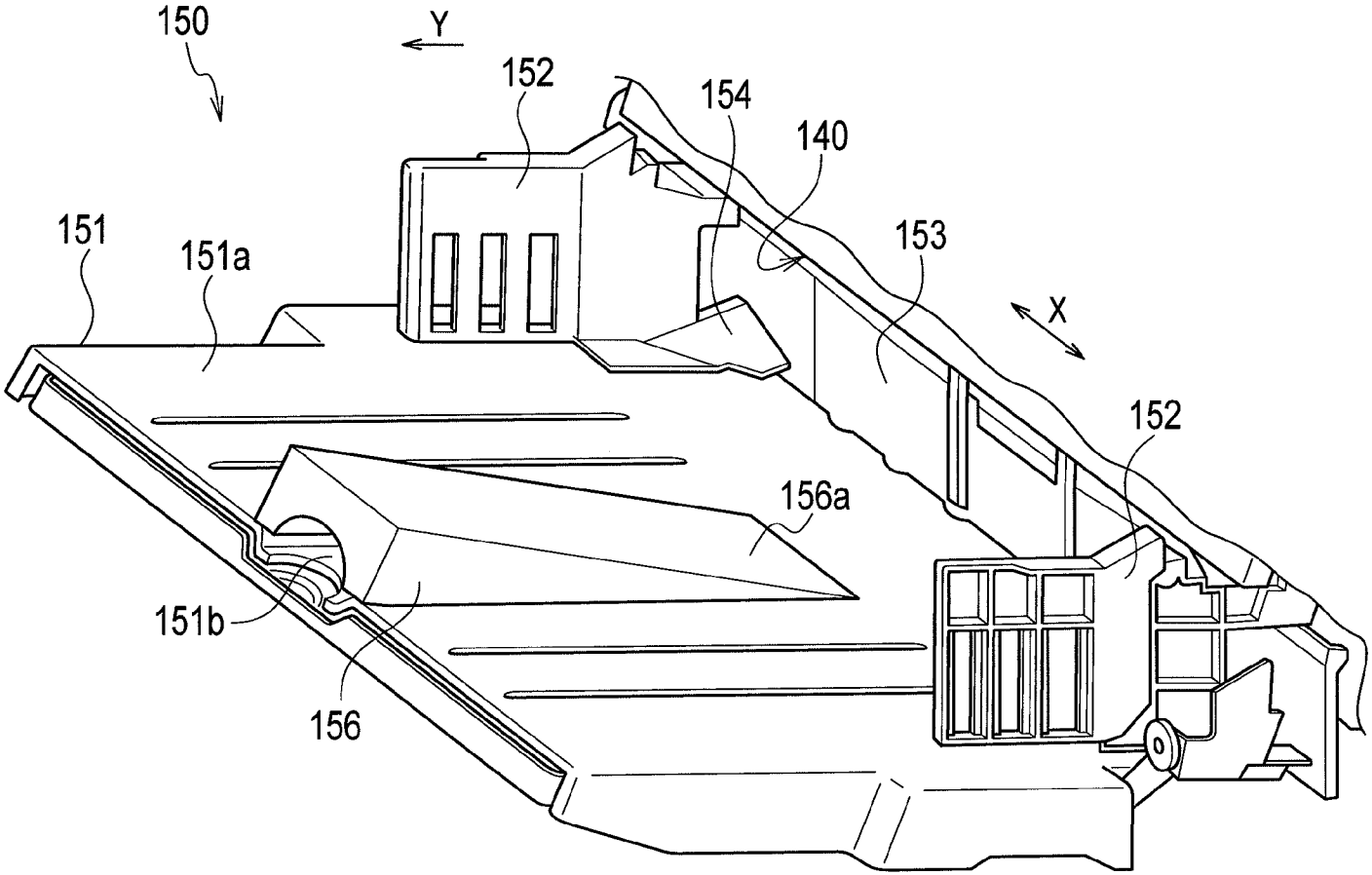
FIG. 4 is an enlarged perspective view of a sheet ejection tray according to a second embodiment of the present invention used in the printer in FIG. 1.

As illustrated in FIG. 4, the sheet ejection tray 150 according to the present embodiment has a projecting member 156 different from the sheet ejection tray 150 of the first embodiment illustrated in FIG. 2 provided on the inclined surface 151*a* of the tray main body 151. The tray main body 151, the pair of side fences 152 and 152, the abutting cover 153, and the pair of rigidity-imparting members 154 and 154 have configurations similar to those of the sheet ejection tray 150 of the first embodiment illustrated in FIG. 2.

Moreover, the projecting member 156 of the present embodiment presents a triangular prism shape having a triangular side face when seen from the width direction X and is mounted in the recess groove 151*b* formed at the center part in the width direction X of the inclined surface 151*a* and extended over the substantially entire length of the inclined surface 151*a* in the sheet ejecting direction Y. The projecting member 156 has a guiding surface 156*a* with inclination larger than that of the inclined surface 151*a* on the sheet ejection port 140 side.

Figure 5:
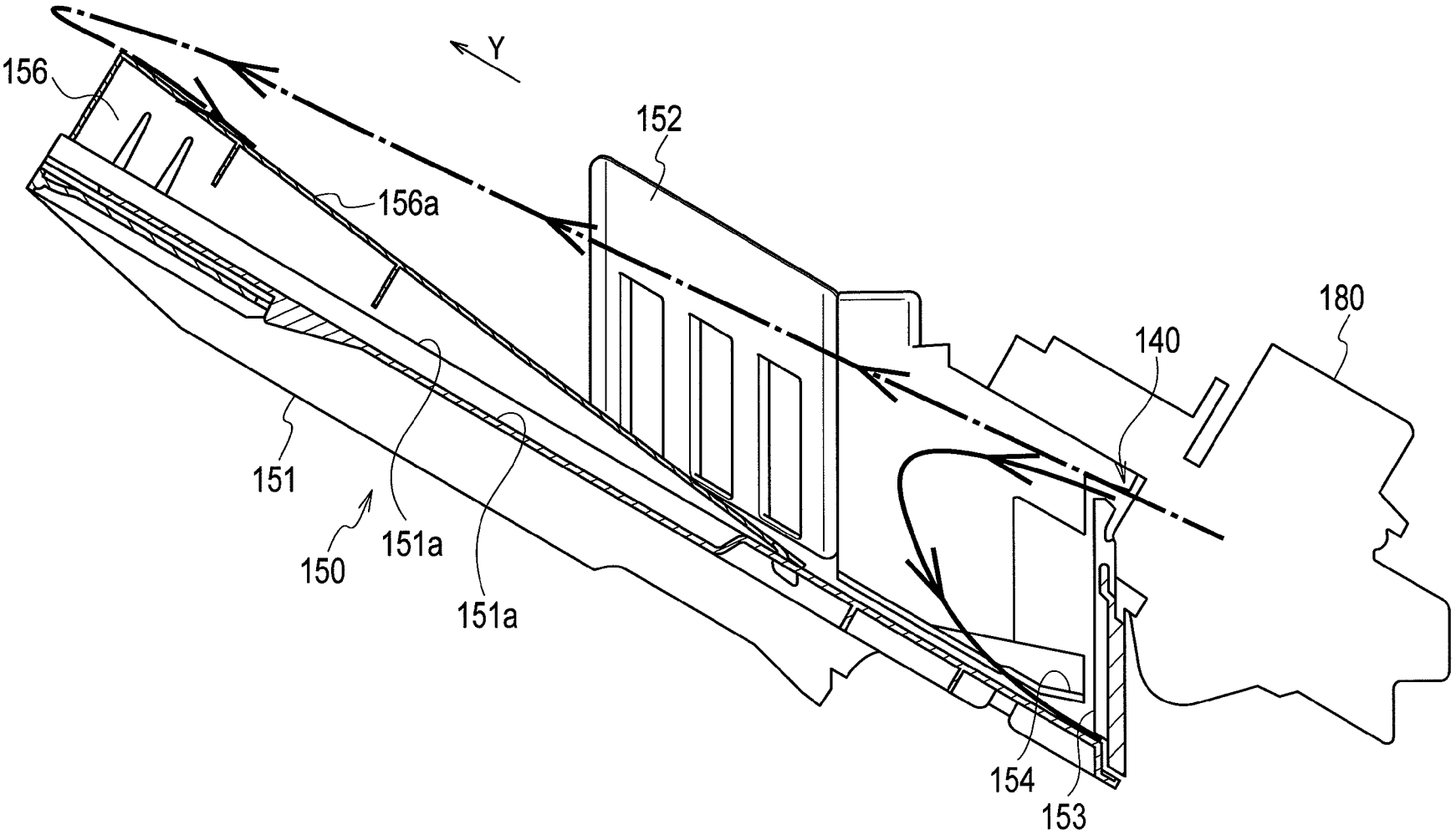
FIG. 5 is a sectional view illustrating positions on the sheet ejection tray of the projecting member in FIG. 4.

The above-described projecting member 156 is, as illustrated in FIG. 5, also arranged in a region closer to the sheet ejection port 140 in the inclined surface 151*a* of the tray main body 151 than a position on which the leading end of the large-sized sheet P having a dimension not smaller than the predetermined value in the sheet ejecting direction Y (sheet P of the A3 size in which the long side is extended in the sheet ejecting direction Y, for example) lands similarly to the projecting member 155 in FIG. 2. However, the projecting member 156 of the present embodiment is configured such that the dimension in the width direction X is shorter than the projecting member 155 in FIG. 2.

A one-dot chain line arrow in FIG. 5 is a trajectory followed by the leading end of the large-sized sheet P ejected from the sheet ejection port 140 by the sheet ejection driving portion 180 and a solid line arrow is a trajectory followed by the rear end of the large-sized sheet P similarly. Note that, FIG. 5 also illustrates a section of the sheet ejection tray 150 at the center in the width direction X, and the trajectory of the rear end of the sheet P is a trajectory passing below the rigidity-imparting member 154. However, on the both ends in the width direction X, the trajectory of the rear end of the sheet P is a trajectory passing above the rigidity-imparting member 154.

As described above, the leading end of the large-sized sheet P ejected from the sheet ejection port 140 passes above the projecting member 156 before landing on the inclined surface 151*a*. Then, after passing above the projecting member 156, the portion closer to the sheet ejection port 140 than the leading end of the sheet P lands on the guiding surface 156*a* of the projecting member 156. The sheet P portion having landed on the guiding surface 156*a* moves to the sheet ejection port 140 side due to inclination of the inclined surface 151*a* while rubbing on the guiding surface 155*a*. Then, the sheet P is guided to the stacking position where the rear end is brought into contact with the abutting cover 153.

At this time, since the speed of the large-sized sheet P moving to the sheet ejection port 140 side is reduced by sliding resistance received from the projecting member 156, an impact generated when the rear end of the sheet P is brought into contact with the abutting cover 153 is relaxed. Therefore, even if the large-sized thin sheet P having a dimension in the sheet ejecting direction Y not smaller than a predetermined value and low rigidity in the sheet ejecting direction Y is ejected onto the sheet ejection tray 150, the rear end side of the sheet P can be prevented from being swollen and curved by the rush when it is brought into contact with the abutting cover 153. Thus, even if the large-sized thin sheet P is ejected from the sheet ejection port 140, sheet alignment of the sheet P can be made hard to be disturbed.

Figure 6:
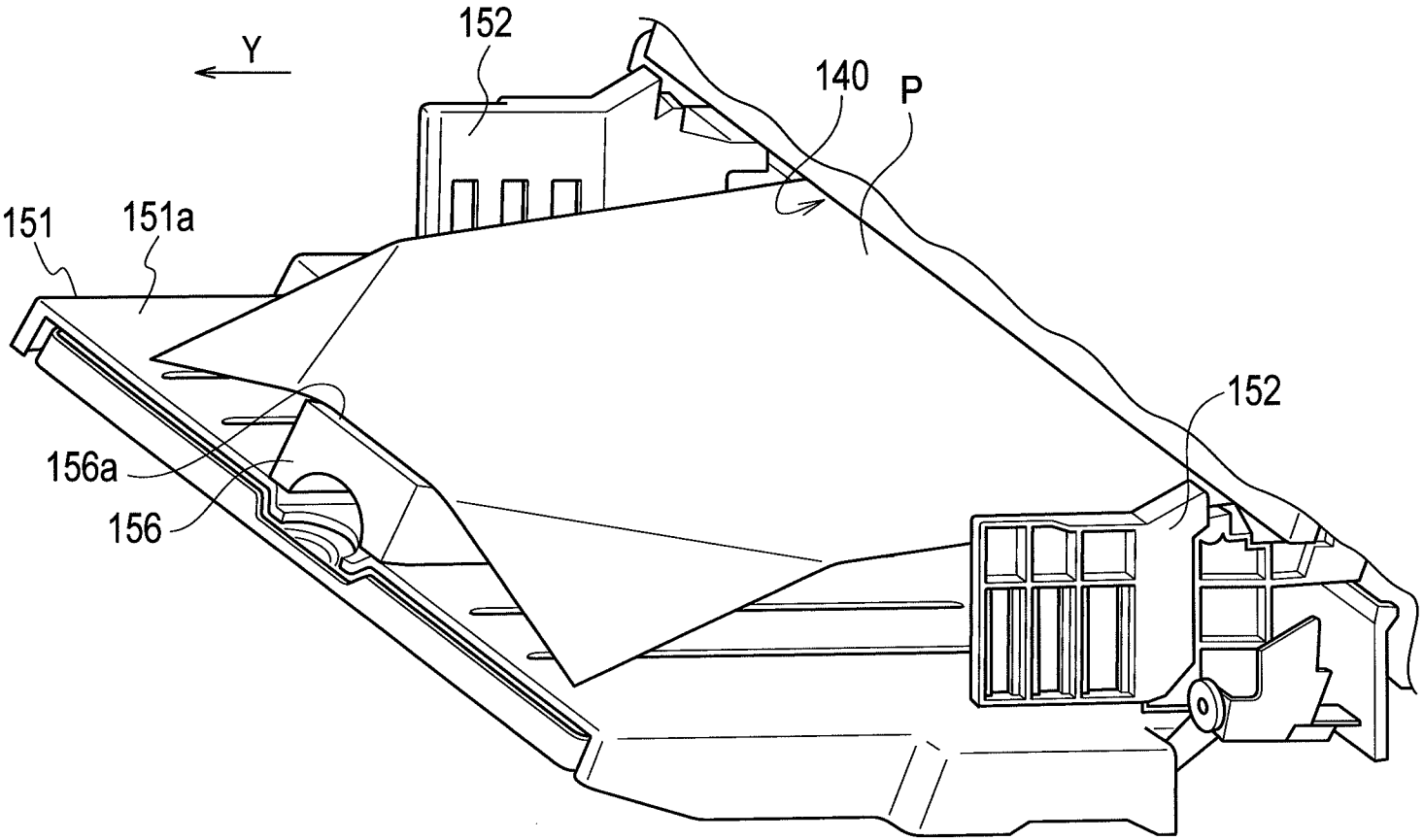
FIG. 6 is a perspective view illustrating a state of a sheet ejected onto the sheet ejection tray in FIG. 4.

Moreover, in the sheet ejection tray 150 of the present embodiment, the dimension of the projecting member 156 in the width direction X is configured to be shorter than that of the projecting member 155 in FIG. 2. Thus, in the sheet P whose portion closer to the leading end has landed on the guiding surface 156*a* of the projecting member 156, the center part in the width direction X in contact with the projecting member 156 is located above the both end portions as illustrated in FIG. 6. Thus, at least the portion of the large-sized sheet P in contact with the guiding surface 156*a* of the projecting member 155 is brought into a state curved in the width direction X.

Thus, when the large-sized sheet P moves to the stacking spot due to inclination of the inclined surface 151*a*, while the leading end side of the sheet P is present on the guiding surface 156*a*, the curved state in the width direction X on the leading end side of the sheet P is maintained, and rigidity of the large-sized sheet P in the sheet ejecting direction Y is reinforced. Thus, in combination with curving of the rear end side of the sheet P in the width direction X by means of the rigidity-imparting members 154 and 154 when the sheet P arrives at the stacking spot, impact resistance when the rear end is brought into contact with the abutting cover 153 is improved. As a result, swelling and curving of the rear end side of the large-sized sheet P due to rush when being brought into contact with the abutting cover 153 can be prevented more efficiently. Therefore, disturbance in sheet alignment of the sheet P when the large-sized thin sheet P is ejected can be prevented more reliably.

Note that, regarding the projecting member 156 of the second embodiment, too, the arrangement length of the projecting member 156 in the sheet ejecting direction Y may be determined so that the leading end of the sheet P is located closer to the sheet ejection port 140 side than the guiding surface 156*a* when the sheet P is guided to the stacking spot. In doing so, the sheet P can be stacked in a stable and flat attitude on the inclined surface 151*a* at the stacking spot.

On the other hand, as in the present embodiment, in a state where the rear end of the sheet P is brought into contact with the abutting cover 153 and the sheet P is guided to the stacking position, it may be so configured that the leading end of the sheet P is located in the middle of the guiding surface 156*a*. In doing so, since the leading end side of the sheet P is continuously curved in the width direction X until the sheet P reaches the stacking spot, reinforcement of rigidity of the sheet P in the sheet ejecting direction Y can be made to continuously act until the sheet P reaches the stacking spot.

Moreover, the projecting members 155 and 156 of the above-described embodiments may be configured such that the inclination of the guiding surfaces 155*a* and 156*a* can be adjusted or the dimension in the width direction X can be adjusted. If the inclination of the guiding surfaces 155*a* or 156*a* is changed, the speed at which, after the sheet P portion closer to the sheet ejection port 140 than the leading end of the large-sized sheet P lands on the guiding surface 155*a* or 156*a*, the sheet P moves to the sheet ejection port 140 side while rubbing on the guiding surface 155*a* or 156*a* is changed. As a result, a degree of an impact received by the large-sized sheet P when the rear end of the sheet P is brought into contact with the abutting cover 153 is changed.

Moreover, if the dimension of the projecting member 155 or 156 in the width direction X of the guiding surface 155*a* or 156*a* is changed, a degree of curving in the width direction X generated on the leading end side of the sheet P is changed, and rigidity in the width direction X of the large-sized sheet P in the sheet ejecting direction Y is changed.

Therefore, in accordance with the change of rigidity in the sheet ejecting direction Y that the large-sized sheet P originally has in a flat state depending on the length of the sheet dimension in the sheet ejecting direction Y, impact when the rear end of the sheet P is brought into contact with the abutting cover 153 and rigidity in the sheet ejecting direction Y can be adjusted appropriately by means of adjustment of at least one of the inclination of the guiding surface 156*a* of the projecting member 156 and the width in the width direction X. As a result, swelling and curving of the rear end side of the large-sized sheet P due to the rush generated when the rear end is brought into contact with the abutting cover 153 can be prevented appropriately.

Moreover, in the above-described embodiment, the printer 100 is described by using an ink-jet type line color printer as an example. However, the present invention can be widely applied to various image forming apparatuses such as an electrophotographic system, a stencil printing method, a multi-path inkjet printer and the like capable of printing and stacked sheet ejection using the thin sheets P.

What is claimed is:

1. A sheet ejection tray on which a sheet ejected from a sheet ejection port of an image forming apparatus lands and which guides the sheet to a stacking position, comprising:

a tray main body positioned to receive sheets in the stacking position;

an inclined surface provided along a top of the tray main body, wherein the sheets are ejected from the sheet ejection port and placed in the stacking position, and wherein a height of the inclined surface increases in accordance with an increase in distance from the sheet ejection port in an ejecting direction of the sheet;

a projecting member provided on the inclined surface of the tray main body, wherein the projecting member has a guiding surface, which is a whole side surface of the projecting member, with an inclination larger than an inclination of the inclined surface, and wherein the guiding surface has a predetermined inclination angle such that the guiding surface comprises a linear surface;

an abutting cover positioned on a rear end portion of the tray main body in the sheet ejecting direction, wherein the abutting cover is configured to be brought into contact with a rear end of the sheet moving toward the sheet ejection port due to the inclination of the guiding surface after the sheet lands on the guiding surface; and a pair of side fences are provided on the rear end portion of the tray main body on opposite sides in a sheet width direction, transverse to the ejecting direction, the side fences being configured to move relative to the tray main body in the sheet width direction, wherein each of the side fences includes a rigidity-imparting member positioned at a rearmost end of each of the side fences, wherein a height of the rigidity imparting member relative to the tray main body in the sheet width direction decreases in accordance with an increase in distance from each of the side fences, and wherein the height of the rigidity-imparting member relative to the tray main body in the ejecting direction decreases in accordance with an increase in distance from the abutting cover.

2. The sheet ejection tray according to claim 1, wherein the projecting member is provided at the center of the inclined surface in the sheet width direction, and the guiding surface has a width smaller than a width of the inclined surface in the sheet width direction.

3. The sheet ejection tray according to claim 1, wherein the projecting member such that when the sheet having the dimension not smaller than the predetermined value is placed at the stacking position, a portion of the projecting member positioned in a side of the sheet ejection port is arranged in a region farther from the sheet ejection port than the leading end of the sheet.

4. The sheet ejection tray according to claim 1, wherein the projecting member such that when the sheet having the dimension not smaller than the predetermined value is placed at the stacking position, a portion of the projecting member positioned in a side of the sheet ejection port is arranged in a region closer to the sheet ejection port than the leading end of the sheet.

5. The sheet ejection tray according to claim 1, wherein the projecting member is positioned in a region closer to the sheet ejection port, in the ejection direction, and is configured such that, when a sheet having a dimension not smaller than a predetermined value first lands on the guiding surface, a leading end of the sheet does not land on the guiding surface, and wherein the projecting member is configured such that the leading end of the sheet having the dimension not smaller than the predetermined value passes above the projecting member before landing on the guiding surface.

6. The sheet ejection tray according to claim 1, wherein the rigidity imparting members are configured to contactingly support a rearmost end of an ejected sheet such that a center of the ejected sheet, in the sheet width direction, is located below both ends of the ejected sheet in the sheet width direction.

7. A sheet ejection tray on which a sheet ejected from a sheet ejection port of an image forming apparatus lands and which guides the sheet to a stacking position, comprising:

a tray main body positioned to receive sheets in the stacking position;

an inclined surface provided along a top of the tray main body, wherein the inclined surface comprises a whole top surface of the tray main body, wherein the inclined surface has a predetermined inclination angle such that the inclined surface comprises a linear surface, wherein the sheets are ejected from the sheet ejection port and placed in the stacking position, and wherein a height of the inclined surface increases in accordance with an increase in distance from the sheet ejection port in an ejecting direction of the sheet;

a projecting member provided on the inclined surface of the tray main body, wherein the projecting member has a guiding surface with an inclination larger than an inclination of the inclined surface;

an abutting cover positioned on a rear end portion of the tray main body in the ejecting direction, wherein the abutting cover is configured to be brought into contact with a rear end of the sheet moving toward the sheet ejection port due to the inclination of the guiding surface after the sheet lands on the guiding surface; and a pair of side fences are provided on the rear end portion of the tray main body on opposite sides in a sheet width direction, transverse to the ejecting direction, the side fences being configured to move relative to the tray main body in the sheet width direction, wherein each of the side fences includes a rigidity-imparting member positioned at a rearmost end of each of the side fences, wherein a height of the rigidity imparting member relative to the tray main body in the sheet width direction decreases in accordance with an increase in distance from each of the side fences, and wherein the height of the rigidity-imparting member relative to the tray main body in the ejecting direction decreases in accordance with an increase in distance from the abutting cover.

8. The sheet ejection tray according to claim 7, wherein the projecting member is positioned in a region closer to the sheet ejection port, in the ejection direction, and is configured such that, when a sheet having a dimension not smaller than a predetermined value first lands on the guiding surface, a leading end of the sheet does not land on the guiding surface, and wherein the projecting member is configured such that the leading end of the sheet having the dimension not smaller than the predetermined value passes above the projecting member before landing on the guiding surface.

9. The sheet ejection tray according to claim 7, wherein the rigidity imparting members are configured to contactingly support a rearmost end of an ejected sheet such that a center of the ejected sheet, in the sheet width direction, is located below both ends of the ejected sheet in the sheet width direction.

10. The sheet ejection tray according to claim 7, wherein the guiding surface of the projecting member comprises a linear surface.

11. A sheet ejection tray on which a sheet ejected from a sheet ejection port of an image forming apparatus lands and which guides the sheet to a stacking position, comprising:

a tray main body positioned to receive sheets in the stacking position;

an inclined surface provided along a top of the tray main body, wherein the sheets are ejected from the sheet ejection port and placed in the stacking position, and wherein a height of the inclined surface increases in accordance with an increase in distance from the sheet ejection port in an ejecting direction of the sheet;

a projecting member provided on the inclined surface of the tray main body, wherein the projecting member has a guiding surface with an inclination larger than an inclination of the inclined surface, and wherein the projecting member is slidably supported by a recess groove provided in a center part of the inclined surface in a width direction of the inclined surface;

an abutting cover positioned on a rear end portion of the tray main body in the ejecting direction, wherein the abutting cover is configured to be brought into contact with a rear end of the sheet moving toward the sheet ejection port due to the inclination of the guiding surface after the sheet lands on the guiding surface; and a pair of side fences are provided on the rear end portion of the tray main body on opposite sides in a sheet width direction, transverse to the ejecting direction, the side fences being configured to move relative to the tray main body in the sheet width direction, wherein each of the side fences includes a rigidity-imparting member positioned at a rearmost end of each of the side fences, wherein a height of the rigidity imparting member relative to the tray main body in the sheet width direction decreases in accordance with an increase in distance from each of the side fences, and wherein the height of the rigidity-imparting member relative to the tray main body in the ejecting direction decreases in accordance with an increase in distance from the abutting cover.

12. The sheet ejection tray according to claim 11, wherein the projecting member is positioned in a region closer to the sheet ejection port, in the ejection direction, and is configured such that, when a sheet having a dimension not smaller than a predetermined value first lands on the guiding surface, a leading end of the sheet does not land on the guiding surface, and wherein the projecting member is configured such that the leading end of the sheet having the dimension not smaller than the predetermined value passes above the projecting member before landing on the guiding surface.

13. The sheet ejection tray according to claim 11, wherein the rigidity imparting members are configured to contactingly support a rearmost end of an ejected sheet such that a center of the ejected sheet, in the sheet width direction, is located below both ends of the ejected sheet in the sheet width direction.

14. The sheet ejection tray according to claim 11, wherein the guiding surface of the projecting member comprises a linear surface.

15. A sheet ejection tray on which a sheet ejected from a sheet ejection port of an image forming apparatus lands and which guides the sheet to a stacking position, comprising:

a tray main body positioned to receive sheets in the stacking position;

an inclined surface provided along a top of the tray main body, wherein the sheets are ejected from the sheet ejection port and placed in the stacking position, and wherein a height of the inclined surface increases in accordance with an increase in distance from the sheet ejection port in an ejecting direction of the sheet;

a projecting member provided on the inclined surface of the tray main body, wherein the projecting member has a guiding surface with an inclination larger than an inclination of the inclined surface, and wherein the projecting member is supported by a recess groove provided in a center part of the inclined surface in a width direction of the inclined surface;

an abutting cover positioned on a rear end portion of the tray main body in the ejecting direction, wherein the abutting cover is configured to be brought into contact with a rear end of the sheet moving toward the sheet ejection port due to the inclination of the guiding surface after the sheet lands on the guiding surface; and a pair of side fences are provided on the rear end portion of the tray main body on opposite sides in a sheet width direction, transverse to the ejecting direction, the side fences being configured to move relative to the tray main body in the sheet width direction, wherein each of the side fences includes a rigidity-imparting member positioned at a rearmost end of each of the side fences, wherein a height of the rigidity imparting member relative to the tray main body in the sheet width direction decreases in accordance with an increase in distance from each of the side fences, and wherein the height of the rigidity-imparting member relative to the tray main body in the ejecting direction decreases in accordance with an increase in distance from the abutting cover.

16. The sheet ejection tray according to claim 15, wherein the projecting member is positioned in a region closer to the sheet ejection port, in the ejection direction, and is configured such that, when a sheet having a dimension not smaller than a predetermined value first lands on the guiding surface, a leading end of the sheet does not land on the guiding surface, and wherein the projecting member is configured such that the leading end of the sheet having the dimension not smaller than the predetermined value passes above the projecting member before landing on the guiding surface.

17. The sheet ejection tray according to claim 15, wherein the rigidity imparting members are configured to contactingly support a rearmost end of an ejected sheet such that a center of the ejected sheet, in the sheet width direction, is located below both ends of the ejected sheet in the sheet width direction.

18. The sheet ejection tray according to claim 15, wherein the guiding surface of the projecting member comprises a linear surface.

* * * * *

UNITED STATES PATENT AND TRADEMARK OFFICE

CERTIFICATE OF CORRECTION

PATENT NO. : 9,248,990 B2
APPLICATION NO. : 13/872671
DATED : February 2, 2016
INVENTOR(S) : Y. Morita It is certified that error appears in the above-identified patent and that said Letters Patent is hereby corrected as shown below:

In the claims:

Column 12, line 13 (claim 3, line 2) please change "member such" to -- member is configured such --

Column 12, line 20 (claim 4, line 2) please change "member such" to -- member is configured such --

Signed and Sealed this
Sixteenth Day of August, 2016

Michelle K. Lee

Michelle K. Lee
*Director of the United States Patent and Trademark Office*